United States Patent [19]

McComb

[11] Patent Number: 4,909,352

[45] Date of Patent: Mar. 20, 1990

[54] LADDER SUPPORT SYSTEM

[76] Inventor: Kevin McComb, 15-B Ridgeview Heights, W. Willington, Conn. 06279

[21] Appl. No.: 371,636

[22] Filed: Jun. 26, 1989

[51] Int. Cl.[4] ..... E06C 5/04

[52] U.S. Cl. ..... 182/127; 182/68

[58] Field of Search ..... 182/127, 68, 64, 97

[56] References Cited

U.S. PATENT DOCUMENTS

| | | | |
|---|---|---|---|
| 2,586,531 | 2/1952 | Gordon . | |
| 2,595,533 | 5/1952 | Mullen . | |
| 3,043,398 | 7/1962 | Bakula | 182/127 |
| 3,123,178 | 3/1964 | Monaghan . | |
| 3,605,943 | 10/1969 | Beaudet | 182/127 |
| 3,621,935 | 11/1971 | Bode | 182/127 |
| 3,907,246 | 9/1975 | LaBate . | |
| 4,175,641 | 11/1979 | Reyes . | |
| 4,408,680 | 10/1983 | Ross | 182/68 |
| 4,527,827 | 7/1985 | Maniscalco . | |
| 4,537,283 | 8/1985 | Humes . | |
| 4,613,181 | 9/1986 | Rafi-Zadeh . | |

*Primary Examiner*—Reinaldo P. Machado
*Attorney, Agent, or Firm*—Ira S. Dorman

[57] ABSTRACT

A system for supporting a lader within the bed of a truck body includes an elongated rack, providing a stable base for the ladder. Boots for receiving the lower end of the ladder can be positioned at selected locations along the length of a rack, and a prop assembly, supported at a spaced location within the truck bed, has a pair of extensible arms that can be pivoted to bring them into engagement with the ladder, to provide lateral support for it.

20 Claims, 4 Drawing Sheets

LADDER SUPPORT SYSTEM

BACKGROUND OF THE INVENTION

There are many instances, such as on construction sites and the like, in which the use of a ladder is required but the means for supporting it safely and stably is inadequate. The terrain may be excessively uneven, irregular or inclined, or there may be no vertical surface available for providing the lateral support necessary to enable the use of a straight ladder.

Gordon U.S. Pat. No. 2,586,531 provides a system that is mounted upon a truck body, which employs a pivoted casing for receiving the rails of a ladder; the lower ends of the rails are engaged in pockets provided on the casing.

Monaghan et al U.S. Pat. No. 3,123,178 also provides a system for supporting a ladder on a truck; a carriage frame is pivotably mounted on the vehicle body, and supports the ladder in use as well as in transport.

The ladder assembly disclosed in Humes U.S. Pat. No. 4,537,283 is specifically designed for mounting in the bucket of a tractor, and it includes auxiliary, groundcontacting bracing means.

Mullen U.S. Pat. No. 2,595,533 shows an assembly having a cross-bar pivotably connected to a pair of uprights, used to support vehicle loading ramps.

Maniscalco U.S. Pat. No. 4,527,827 and Rafi-Zadeh U.S. Pat. No. 4,613,181 disclose assemblies for carrying, respectively, a surfing board and a bed cover on a pickup truck. Reyes U.S. Pat. No. 4,175,641 shows an arrangement for laterally supporting a step ladder, and LaBate U.S. Pat. No. 3,907,246 provides a self-wedging device for holding side boards in position in ingot molds.

It is the broad object of the invention to provide a novel system for supporting a straight ladder, and more specifically to provide a novel ladder-supporting system that is adapted for installation in the bed of a truck body. Other objects of the invention are to provide such a system which is not only highly effective for its intended purposes, but is also relatively facile to manufacture and install.

SUMMARY OF THE INVENTION

It has now been found that the foregoing and related objects of the invention are readily attained by the provision of a ladder support system comprised of cooperating ratchet and prop assemblies. The ratchet assembly includes an elongated rack that is of uniform width along at least a major part of its length, and that has a top surface with transversely extending serrations. Means at the opposite ends of the rack serve to engage the side walls of a truck body bed, for disengagably affixing the ratchet assembly in position. The assembly also includes a pair of boot members, each having a base and a shoe pivotably mounted thereon. The base is seated upon the top surface of the rack member; it has means for constraining it to lateral movement therealong, and it has an element that is engagable with the serrations to maintain the boot in a selected seated position along the length of the rack. The shoe member is pivotable on an axis parallel to the longitudinal axis of the rack member, and it is adapted to receive and support a lower end portion of the ladder side rail. The prop assembly comprises a support member with a pair of outwardly extending arm members of adjustable length, each having means on its free outer end for engaging a ladder part. The assembly is adapted to readily permit variation of the angular attitude of the arm members, for engagement of the ladder parts.

The system will desirably include at least one part that is mounted upon the rack member and is axially extensible therefrom, the rack member and the extensible part having cooperating means (such as mated thread portions) for affixing them in various positions of relative extension, and the extensible part having a free outer end with means thereon for contacting a surface of the truck body to cooperate in securing the ratchet assembly in position. A second such part may be provided and assembled with the rack member to extend in the opposite direction, and the means for contacting the walls will advantageously comprise pressure plates mounted on the free outer ends of the extensible parts.

The base of each of the boots may comprise a pair of spaced plates affixed to one another, each of the plates having a lower portion with an upwardly extending indentation that is dimensioned and configured to receive the rack member in snug, slidable engagement, and with a tongue element disposed along the upper edge of the indentation of at least one of the plates providing the engagable element of the base member. The plates will advantageously be affixed to one another by a cylindrical piece that extends between them, which also provides the means for pivotable mounting of the shoe upon the base.

Each of the arm members of the prop assembly will desirably comprise a plurality of sections that are telescopically interengaged with one another and that have means thereon for affixing them in positions of variable extension relative to one another. The support member of the prop assembly will usually be elongated, and adapted to be mounted for rotation about its longitudinal axis, with the arm members being rigidly attached to the support member at spaced locations along its length. In such an embodiment the prop assembly may additionally include a supporting unit that is comprised of a beam having a pair of end pieces journaling the opposite ends of the support member.

The system may also include a brace assembly that extends between the ratchet assembly and the prop assembly and that serves to rigidly maintain them against movement toward one another. Members comprising such a brace assembly will have means on free opposite ends thereof for engaging components of the ratchet assembly and the prop assembly, respectively, and the members will be capable of selective relative extension for variation of the effective length of the brace assembly.

DETAILED DESCRIPTION OF THE ILLUSTRATED EMBODIMENT

Figure 1:
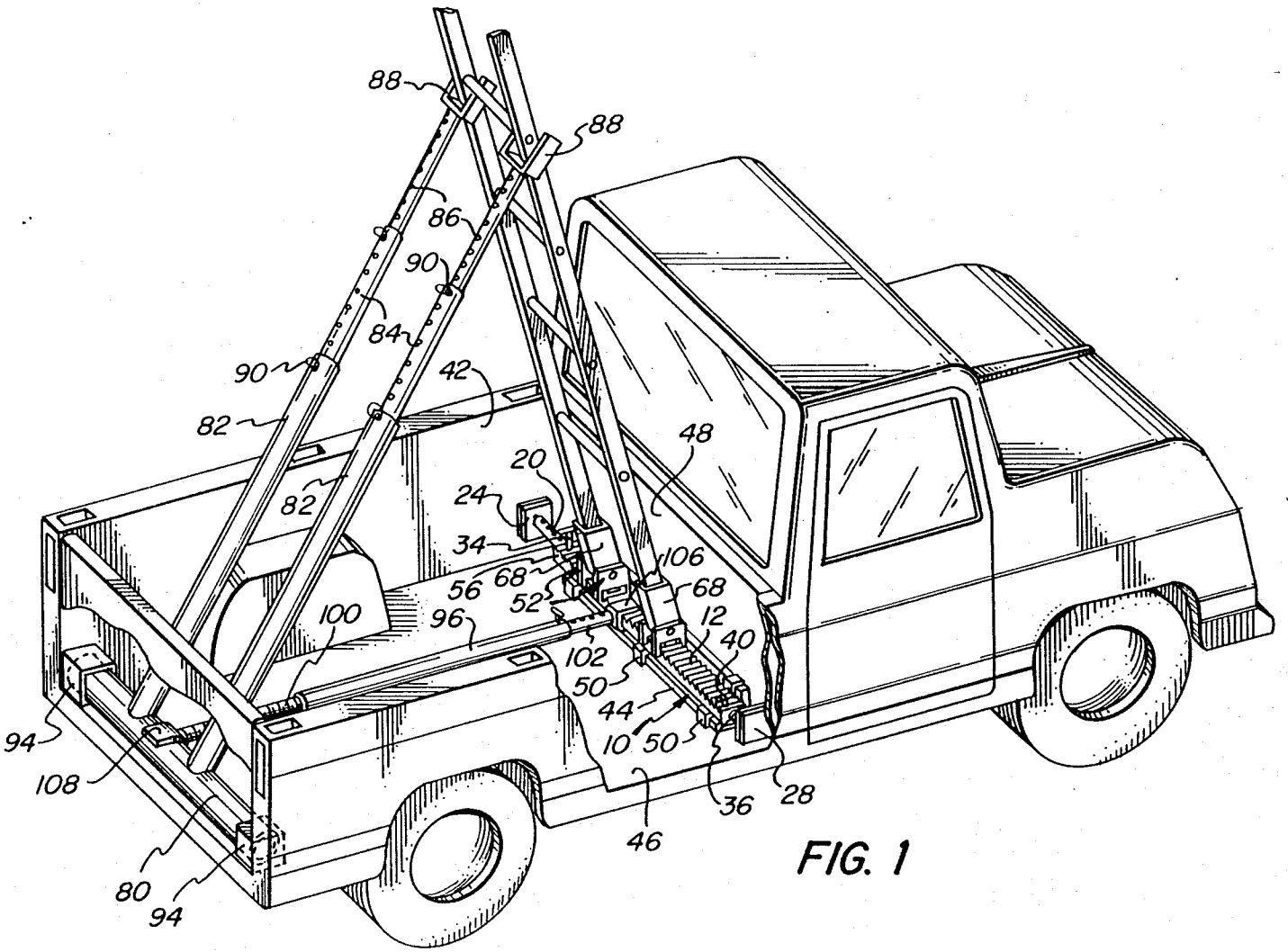
FIG. 1 is a perspective view of a system embodying the invention installed within the bed of pickup truck and supporting a ladder, portions of the truck body being broken away to expose features of the support system.
Figure 2:
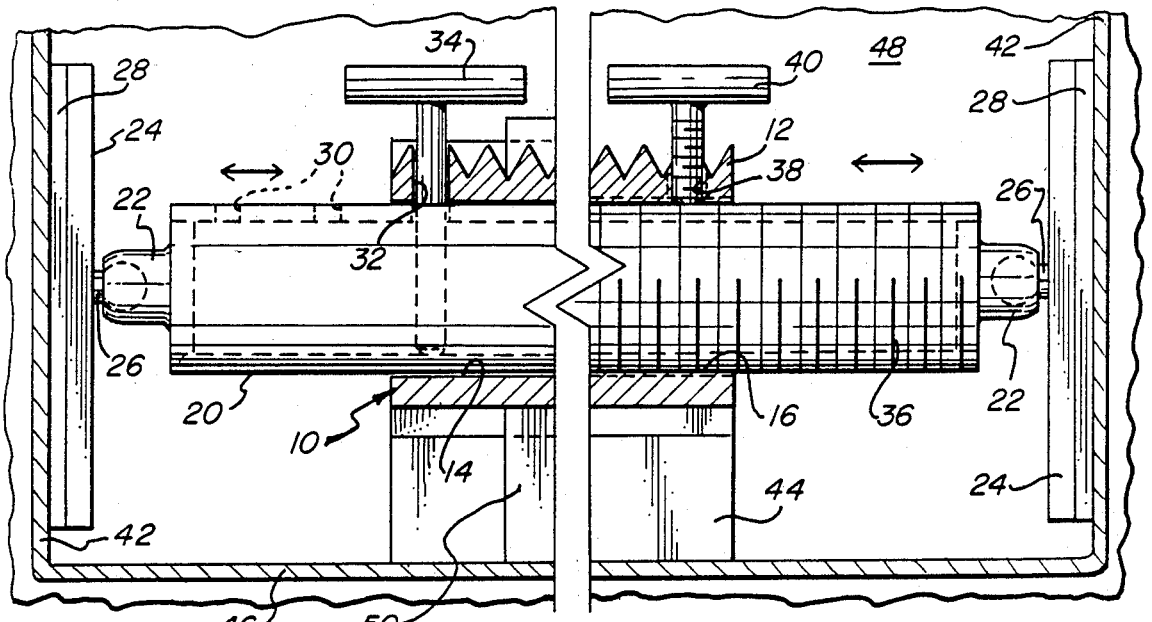
FIG. 2 is a fragmentary side elevational view of the ratchet assembly of which the system is comprised, drawn to a scale greatly enlarged from that of FIG. 1 and showing certain elements in cross section.
Figure 3:
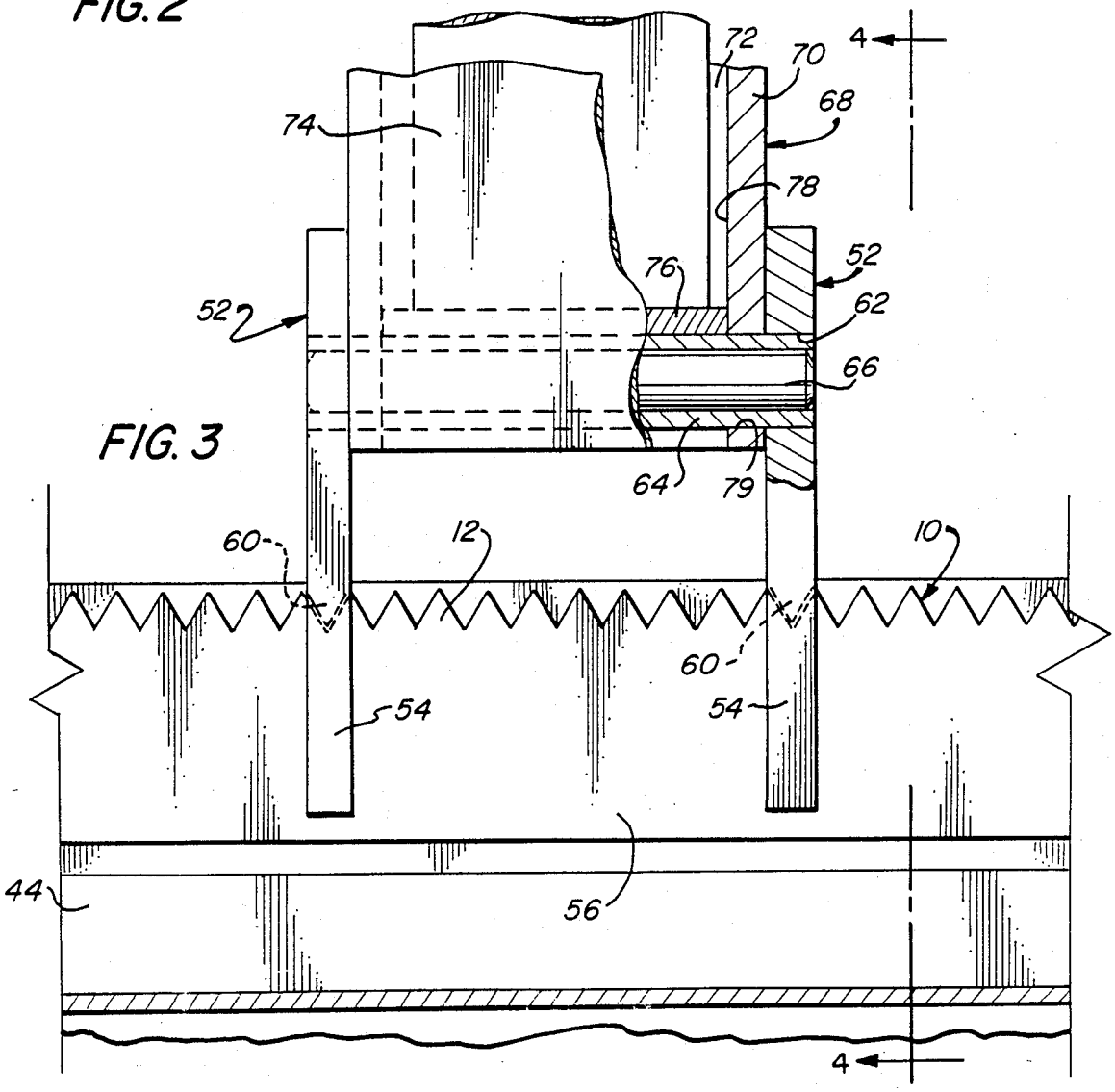
FIG. 3 is a fragmentary side elevational view, drawn to a scale further enlarged from that of FIG. 2, showing a central portion of the ratchet assembly, including a seated boot member, with portions in section to show internal features.
Figure 4:
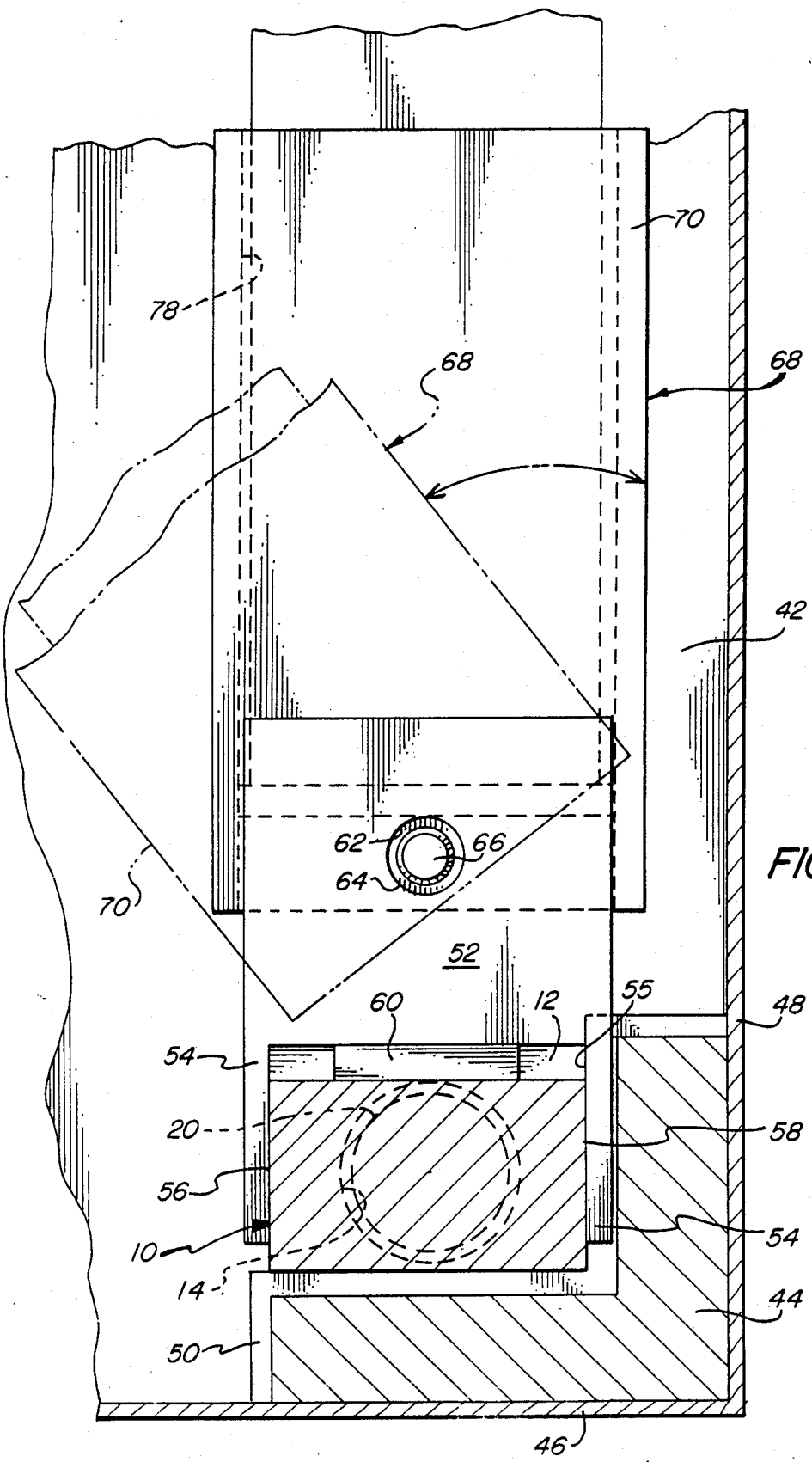
FIG. 4 is a fragmentary vertical sectional view taken along line 4—4 of FIG. 3 and drawn to the scale thereof, showing the boot member in both upright (full line) and also pivoted (phantom line) positions.

Turning now in detail to the appended drawings, FIG. 1 shows the system of the invention installed within the bed of a pickup truck body and supporting a straight ladder therewithin. The system comprises a ratchet assembly, a prop assembly and a brace assembly, each of which will be more fully described hereinbelow.

The ratchet assembly consists of an elongated, rectilinear rack, generally designated by the numeral 10, having a serrated upper portion 12 extending along its entire length. A smooth bore 14 extends axially into one end of the rack 10, and telescopically receives a tubular extension piece 20. The piece 20 has a socket element 22 on its outer end, which serves to mount a pressure plate 24 by engagement of the ball element on the end of its mounting post 26 therewithin, thereby permitting universal pivoting movement of the plate 24. A friction pad 28 is bonded to the outer face of the pressure plate 24; normally, the pad will be made of a tough, resilient elastomeric material.

Engaged within the threaded bore 16, extending axially into the opposite end of the rack member 10, is a threaded shaft 36, which also receives the ball of the mounting post 26 of a pressure plate 24 and friction pad 28 subassembly within a socket element 22 on its outer end, for pivotable movement as hereinabove described. A thumb screw 40 is engaged within a threaded aperture 38 formed through the wall of the rack member 10, and can be used to ensure that the threaded shaft 36 is maintained in fixed position. Similarly, a pin 34 extends through the aperture 32 through the rack wall and into one of the apertures 30 formed in the extension piece 20, to affix it in a selected position of extension. As will be appreciated, the piece 20 and the shaft 36 provide a rough and a fine adjustment, respectively, for cooperatively bringing the pressure plate assemblies into firm engagement with the inside walls of the truck body, thereby securing the rack in position therewithin.

An elongated, right-angle piece 44 is installed against the floor 46 and front wall 48 of the body, and serves to seat the rack 10. Three metal spacers 50, of zigzag form, are provided at spaced locations along the length of the angle piece 44. The rack member 10 rests upon the spacers, which provide the clearances necessary to permit movement of the parts, as will hereinafter be described.

Two identical boot subassemblies are seated in spaced relationship upon the rail member 10. Each consists of a pair of heavy gauge, rectangular side plates 52, the lower ends of which are upwardly indented at 55 to define spaced leg portions 54. The indentation 55 is so dimensioned and configured as to cause the leg portions 54 to slidably engage the forward and rearward surfaces 56, 58, respectively, of the rail member 10 when the boot subassembly is seated thereupon. A short tab or tongue element 60 extends downwardly into the indentation 55, and is configured to mesh with the serrations of the rack member upper portion 12.

The panels 52 have holes 62 extending through their upper portions in a centralized location, within which are engaged the opposite ends of a bushing 64/rod 66 couple. The bushing/rod couple serves not only to assemble the plates 52 to one another, but also to pivotably mount a box-like shoe, which is generally designated by the numeral 68 and which comprises side walls 70, front wall 72, rear wall 74, and bottom wall 76; the side walls 70 are formed with holes 79 to pivotably receive the bushing 64.

The prop assembly of the system consists of a cylindrical base 80, and a pair of parallel tubular sleeves 82 which extend radially therefrom. A tubular intermediate section 84 is telescopically received within each sleeve 82, and the sections 84 telescopically receive, in turn, tubular end sections 86, each having a clevis piece 88 affixed to its free, outer end. A row of small apertures (unnumbered) extends lengthwise along each of the sections 84 and 86, and a single aperture (not visible) is provided adjacent the free end of each sleeve 82; the apertures receive the shafts of locking pins 90 for affixing the sections of the telescoping arms in selected relative positions.

Figure 6:
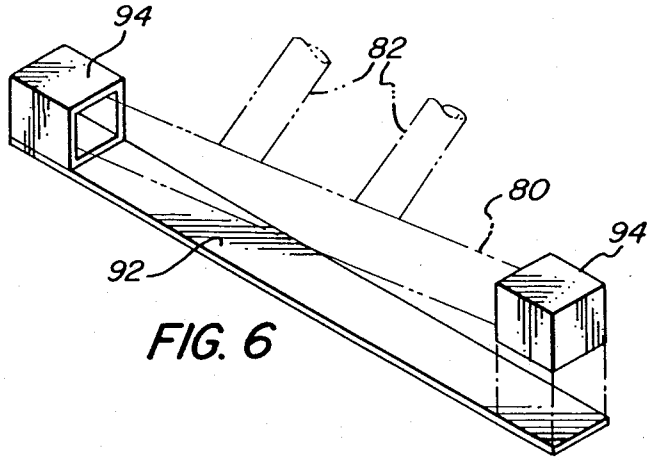
FIG. 6 is a perspective view of the mounting unit for the prop assembly (the latter being shown fragmentarily and in phantom line), one of the end pieces of the mounting unit being displaced from the supporting beam for illustrative purposes.
Figure 5:
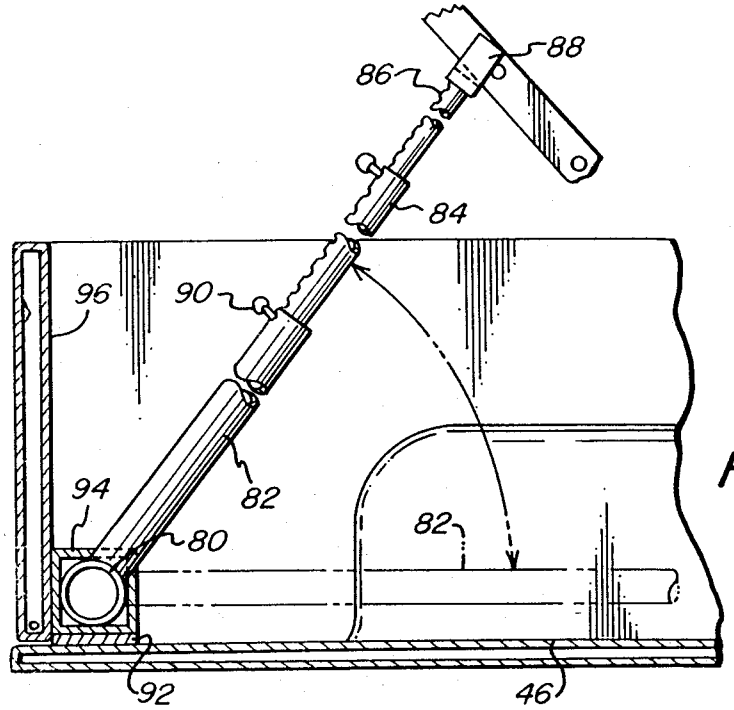
FIG. 5 is a fragmentary vertical sectional view taken along the longitudinal axis of the truck body, showing the prop assembly of the system with the arms in both an inclined (full line) and also a stored (phantom line) position, and drawn substantially to the scale of FIG. 1.
Figure 7:
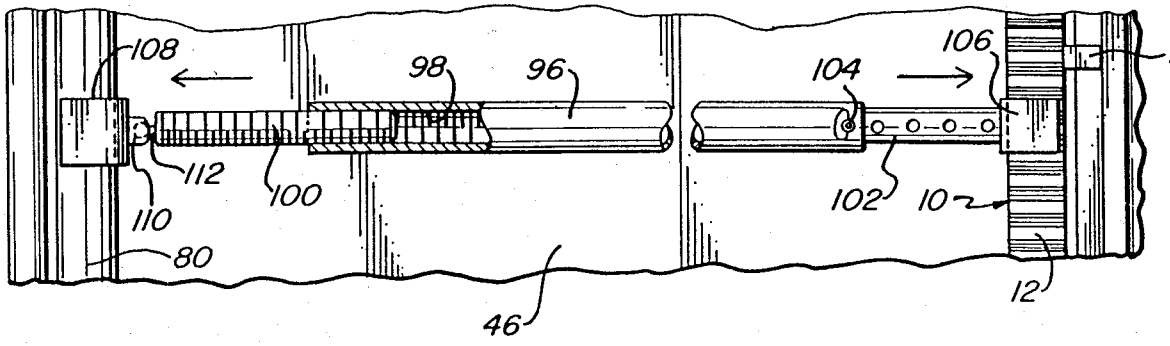
FIG. 7 is a fragmentary plan view, in partial section, showing the brace assembly employed in the system, engaged with the rack and the cylindrical base, respectively, of the ratchet and prop assemblies.

The prop assembly is installed at the rear of the truck bed, and is supported by a mounting unit, best seen in FIG. 6. The unit consists of a beam 92 having box-like pieces 94 affixed to its opposite ends. The confronting sides of the pieces 94 are open, and serve to rotatably receive the ends of the cylindrical base 80 therewithin, thereby permitting the arm subassemblies to readily be raised and lowered, as indicated in FIG. 5.

The system is rigidified by use of a brace assembly that extends longitudinally between the rack member 10 of the ratchet assembly and the base 80 of the prop assembly, and that serves to positively maintain them in position at the opposite ends of the truck bed. The brace assembly consists of a tubular sleeve 96, which is threaded internally at one end to receive the screw 100. A smaller diameter tubular section 102 is telescopically received within the opposite end of the sleeve 96, and an arrangement of apertures is employed to enable affixation of the section 102 in a selected extended position, using the pin 104. A square clevis 106 is attached to the free end of the section 102, for snugly engaging the rack member 10, and a U-shaped clevis 108 is pivotably mounted on the end of the screw 100, using the ball element 112 and socket element 110 provided, to engage the cylindrical base 80. The brace assembly is brought into firm engagement with the cooperating members by use of the fine and gross adjustments afforded by the screw 100 and tubular extension 102.

As is seen in FIG. 1, the base of the ladder is stably supported simply by inserting the ends of its lateral rails into the recesses of the shoes 68, which recesses will typically be about six inches deep. Lateral support is provided by elevating and extending the arms of the prop assembly to bring them into engagement with the rails of the ladder, normally by positioning them at a location beneath a rung for maximum security; each component 82, 84, 86 of the arms will typically be about 4 feet in length, enabling the arms to extend from about 4 feet to about 12 feet overall. Needless to say, the boot subassemblies are moved on the rack member 10 simply by lifting them slightly away from the top portion 12 so as to disengage the tongues 60 of the side plates 52 from the serrations thereof. They can thereby be readily spaced for proper receipt of the rails, and also to locate the ladder at a desired position across the truck body. Tilting of the shoes permits the ladder to be angled as desired, without compromise of the excellent stability and support afforded by the rack.

As will be appreciated, variations can be made in the several parts and features of the support system of the invention without deviating from the novel concepts hereof. For example, hydraulic or pneumatic means may be used to bring the pressur plates into engagement with the side walls of the truck body to affix the ratchet assembly in position, and alternative means for achieving the functions of the serrated rack and the boot-like receptacle members may occur to those skilled in the art. Similarly, while the prop assembly illustrated employs a rotatable supporting member with telescoping arms affixed thereto, in accordance with what is regarded to be the best mode for practicing the invention, a fixed base with pivotably attached arms could be employed instead.

It will be appreciated that the brace assembly is not an essential feature of the instant system, albeit that it contributes fundamentally to the provision of a highly stable and rigid triangulated structure (in cooperation with the supported ladder), when employed. Indeed, perhaps it should be specifically noted that the end fixtures of the brace may be designed to secure the prop and ratchet assemblies against relative movement in both directions (i.e., with the brace acting in both tension and compression), so as to provide a free-standing, independent system needing no support from a truck or other external structure. Finally, it should be appreciated that the system described is capable of use in other application; for example, by augmenting it with a power-driven winch mechanism the system could serve as a hoist.

Thus, it can be seen that the present invention provides a novel system for supporting a straight ladder, and more specifically a novel ladder-supporting system that is adapted for installation in the bed of a truck body. The system is highly effective for its intended purposes, and it is relatively facile to manufacture and install.

Having thus described the invention, what is claimed is:

1. A system for supporting a ladder within the bed of a pickup truck body, or the like, comprising:

(a) a ratchet assembly comprising an elongated rack member that is of uniform width along at least a major part of its length, and that has a serrated top surface thereon, the serrations of said top surface extending transversely across said rack member; means at the opposite ends of said rack member for engaging the side walls of a truck body defining the bed thereof, for disengagably affixing said rack member in position thereacross; and a pair of boot members, each including:

(1) a base member seated upon said top surface of said rack member and having means thereon for constraining said base member to lateral movement therealong when so seated, said base member also having an element thereon that is engagable with said serrations of said rack member when so seated for maintaining said boot member in a selected position along the length thereof; and (2) a shoe member mounted upon said base member upwardly of said rack member for pivotable movement on an axis parallel to the longitudinal axis of said rack member, said shoe member being adapted to receive and support a lower end portion of a side rail of a ladder therewithin; and (b) a prop assembly comprising a support member and a pair of arm members extending outwardly from said base, each of said arm members being of adjustable length and having a free outer end with means thereon for engaging a ladder part.

2. The system of claim 1 including a part that is mounted upon said rack member and is axially extensible therefrom, said rack member and extensible part having cooperating means for affixing them in various positions of relative extension of said extensible part, said extensible part having a free outer end with means thereon for contacting a surface of the truck body to cooperate in securing said ratchet assembly therewithin.

3. The system of claim 2 wherein a second said extensible part is assembled with said rack member and extends axially therefrom in the direction opposite to the direction of extension of said first-mentioned extensible part, and wherein said rack member has cooperating means for so affixing said second part.

4. The system of claim 2 wherein said means for contacting comprises a pressure plate mounted on said free outer end of said extensible part, and wherein said cooperating means for affixing comprises mated thread portions on said extensible part and said rack member.

5. The system of claim 1 wherein said ratchet assembly additionally includes an elongated support piece extending substantially along the length of said rack member, and a plurality of spacers interposed between said support piece and said rack member at spaced locations therealong and establishing clearance therebetween.

6. The system of claim 1 wherein said base member of each of said boot members comprises a pair of plates affixed to one another with spacing therebetween, each of said plates having a lower portion with an indentation extending upwardly thereinto dimensioned and configured to receive said rack member in snug, slidable engagement therewith, said engagable element of said base member comprising a tongue element disposed along the upper edge of said indentation of at least one of said plates.

7. The system of claim 6 wherein said plates are affixed to one another by a cylindrical piece extending therebetween, said cylindrical piece also providing the means for pivotable mounting of said shoe member upon said base member.

8. The system of claim 1 wherein each of said arm members of said prop assembly comprises a plurality of sections telescopically interengaged with one another and having means thereon for affixing said sections in positions of variable extension relative to one another.

9. The system of claim 8 wherein said support member is elongated and is adapted to be mounted for rotation about the longitudinal axis thereof, and wherein said arm members are rigidly attached to said support member at spaced locations along the length thereof.

10. The system of claim 9 additionally including a supporting unit for said prop assembly, said supporting unit comprising a beam having a pair of end pieces thereon adapted to journal the opposite ends of said support member therewithin.

11. The system of claim 1 additionally including a brace assembly extending between said ratchet assembly and said prop assembly and rigidly maintaining them against movement toward one another, said brace assembly including members of selective relative extension for variation of the length thereof, said members of said brace assembly having means on free opposite ends thereof for engaging said ratchet assembly and said prop assembly, respectively.

12. A system for supporting a ladder within the bed of a pickup truck body, or the like, comprising:

(a) a ratchet assembly comprising an elongated rack member that is of uniform width along at least a major part of its length, and that has a serrated top surface thereon, the serrations of said top surface extending transversely across said rack member; and a pair of boot members, each including:

(1) a base member seated upon said top surface of said rack member and having means thereon for constraining said base member to lateral movement therealong when so seated, said base member also having an element thereon that is engagable with said serrations of said rack member when so seated for maintaining said boot member in a selected position along the length thereof; and (2) a shoe member mounted upon said base member upwardly of said rack member for pivotable movement on an axis parallel to the longitudinal axis of said rack member, said shoe member being adapted to receive and support a lower end portion of a side rail of a ladder therewithin;

(b) a prop assembly comprising a support member and a pair of arm members extending outwardly from said base, each of said arm members being of adjustable length and having a free outer end with means thereon for engaging a ladder part; and (c) a brace assembly extending between said ratchet assembly and said prop assembly and rigidly maintaining them against movement toward one another, said brace assembly including members of selective relative extension for variation of the length thereof, said members of said brace assembly having means on free opposite ends thereof for engaging said ratchet assembly and said prop assembly, respectively.

13. The system of claim 12 wherein said base member of each of said boot members comprises a pair of plates affixed to one another with spacing therebetween, each of said plates having a lower portion with an indentation extending upwardly thereinto dimensioned and configured to receive said rack member in snug, slidable engagement therewith, said engagable element of said base member comprising a tongue element disposed along the upper edge of said indentation of at least one of said plates; and wherein said plates are affixed to one another by a cylindrical piece extending therebetween, said cylindrical piece also providing the means for pivotable mounting of said shoe member upon said base member.

14. The system of claim 12 wherein each of said arm members of said prop assembly comprises a plurality of sections telescopically interengaged with one another and having means thereon for affixing said sections in positions of variable extension relative to one another.

15. A ladder system comprising:

(a) a ratchet assembly comprising an elongated rack member that is of uniform width along at least a major part of its length, and that has a serrated top surface thereon, the serrations of said top surface extending transversely across said rack member; means at the opposite ends of said rack member for engaging the side walls of a truck body defining the bed thereof, for disengagably affixing said rack member in position thereacross; and a pair of boot members, each including:

(1) a base member seated upon said top surface of said rack member and having means thereon for constraining said base member to lateral movement therealong when so seated, said base member also having an element thereon that is engagable with said serrations of said rack member when so seated for maintaining said boot member in a selected position along the length thereof; and (2) a shoe member mounted upon said base member upwardly of said rack member for pivotable movement on an axis parallel to the longitudinal axis of said rack member, said shoe member being adapted to receive and support a lower end portion of a side rail of a ladder therewithin;

(b) a prop assembly comprising a support member and a pair of arm members extending outwardly from said base, each of said arm members being of adjustable length and having a free outer end with means thereon for engaging a ladder part;

(c) a brace assembly extending between said ratchet assembly and said prop assembly and rigidly maintaining them against movement toward one another, said brace assembly including members of selective relative extension for variation of the length thereof, said members of said brace assembly having means on free opposite ends thereof for engaging said ratchet assembly and said prop assembly, respectively; and (d) a straight ladder having side rails with lower end portions received within and supported by said shoe members, and having parts engaged by said means for engaging of said prop assembly arm members.

16. The system of claim 15 wherein said base member of each of said boot members comprises a pair of plates affixed to one another with spacing therebetween, each of said plates having a lower portion with an indentation extending upwardly thereinto dimensioned and configured to receive said rack member in snug, slidable engagement therewith, said engagable element of said base member comprising a tongue element disposed along the upper edge of said indentation of at least one of said plates.

17. A ladder system comprising:

(a) a ratchet assembly comprising an elongated rack member that is of uniform width along at least a major part of its length, and that has a serrated top surface thereon, the serrations of said top surface extending transversely across said rack member; and a pair of boot members, each including:

(1) a base member seated upon said top surface of said rack member and having means thereon for constraining said base member to lateral movement therealong when so seated, said base member also having an element thereon that is engagable with said serrations of said rack member when so seated for maintaining said boot member in a selected position along the length thereof; and (2) a shoe member mounted upon said base member upwardly of said rack member for pivotable movement on an axis parallel to the longitudinal axis of said rack member, said shoe member being adapted to receive and support a lower end portion of a side rail of a ladder therewithin;

(b) a prop assembly comprising a support member and a pair of arm members extending outwardly from said base, each of said arm members being of adjustable length and having a free outer end with means thereon for engaging a ladder part;

(c) a brace assembly extending between said ratchet assembly and said prop assembly and rigidly maintaining them against movement toward one another, said brace assembly including members of selective relative extension for variation of the length thereof, said members of said brace assembly having means on free opposite ends thereof for engaging said ratchet assembly and said prop assembly, respectively; and (d) a straight ladder having side rails with lower end portions received within and supported by said shoe members, and having parts engaged by said means for engaging of said prop assembly arm members.

18. The system of claim 17 wherein said base member of each of said boot members comprises a pair of plates affixed to one another with spacing therebetween, each of said plates having a lower portion with an indentation extending upwardly thereinto dimensioned and configured to receive said rack member in snug, slidable engagement therewith, said engagable element of said base member comprising a tongue element disposed along the upper edge of said indentation of at least one of said plates.

19. The system of claim 18 wherein said plates are affixed to one another by a cylindrical piece extending therebetween, said cylindrical piece also providing the means for pivotable mounting of said shoe member upon said base member.

20. The system of claim 17 wherein each of said arm members of said prop assembly comprises a plurality of sections telescopically interengaged with one another and having means thereon for affixing said sections in positions of variable extension relative to one another.

* * * * *